US006749149B1

(12) United States Patent
Friesen

(10) Patent No.: US 6,749,149 B1
(45) Date of Patent: Jun. 15, 2004

(54) PAPER TOWEL HOLDER

(75) Inventor: Jed C. Friesen, Vancouver (CA)

(73) Assignee: Englewood Ventures Inc., Surrey (CA)

( * ) Notice: Subject to any disclaimer, the term of this patent is extended or adjusted under 35 U.S.C. 154(b) by 0 days.

(21) Appl. No.: 10/308,019

(22) Filed: Dec. 3, 2002

(51) Int. Cl.[7] ..... B65H 16/06
(52) U.S. Cl. ..... 242/596.7; 242/611.2
(58) Field of Search ..... 242/596.7, 611.2, 242/597.6, 129.51, 129.52

(56) References Cited

U.S. PATENT DOCUMENTS 2,380,644 A * 7/1945 Grondona ..... 242/596.7
RE25,828 E * 8/1965 Wooster ..... 242/596.7
3,797,769 A * 3/1974 Tucke ..... 242/596.7
4,013,240 A * 3/1977 Perrin ..... 242/596.7
4,295,921 A * 10/1981 Bopst ..... 242/596.7
4,535,947 A * 8/1985 Hidle ..... 242/596.7

* cited by examiner

*Primary Examiner*—John M. Jillions
(74) *Attorney, Agent, or Firm*—Vermette & Co.

(57) ABSTRACT

A support arm for supporting a paper towel roll, having selected openings in one end, in a paper towel dispenser, and having a dispenser engaging arm portion, a cylindrical portion affixed to the arm portion, and an outer sleeve abutting a first side of the cylindrical portion. An inner sleeve slidably engages a second side of the cylindrical portion. An interconnecting structure interconnects the inner and outer sleeves and is insertable into the selected openings in the end of the paper towel.

6 Claims, 3 Drawing Sheets

PAPER TOWEL HOLDER

FIELD

The present invention relates to a paper towel holder for supporting a roll of paper in a paper towel dispenser.

BACKGROUND

Commercial paper towel dispensers must support a large roll of paper towel material so that the roll can rotate in response to pulling on the leading edge of the paper. Various marketing strategies have been employed in marketing paper towel dispensers and paper towel material. One such strategy has been for paper companies to sell the paper towel material directly to the customer and the paper towel dispenser manufacturers to sell their dispensers independently of the paper towel suppliers to the same customers. This strategy requires the customer to deal with two different suppliers rather than just one. Recently paper manufacturers have taken on the role of supplying not only paper but also the dispensers. Accordingly, a great deal of interest has developed in ways of ensuring only the paper of a particular manufacturer can be used with a particular dispenser.

Accordingly, it is an object of the invention to provide a paper towel roll holder that can be used with only paper towel rolls of a particular paper company.

SUMMARY OF THE INVENTION

According to the invention there is provided a support arm for supporting a paper towel roll, the roll having selected openings in one end, in a paper towel dispenser, and having a dispenser engaging arm portion, a cylindrical portion affixed to the arm portion, and an outer sleeve abutting a first side of the cylindrical portion. An inner sleeve slidably engages a second side of the cylindrical portion. An interconnecting structure interconnects the inner and outer sleeves and is insertable into the selected openings in the end of the paper towel.

The selected openings may include a cylindrical opening in a center of the roll and slots cut into the end of the roll from the cylindrical opening in a preselected orientation.

Preferably the inner sleeve is slidably insertable into the cylindrical opening in the end of the roll.

The interconnecting structure may be a plurality of radially directed webs extending outwardly of the inner sleeve.

Advantageously, the inner sleeve has a plurality of tabs with outwardly directed shoulders which can be press-fitted through an opening in a center of said cylindrical portion and snap out such that the shoulders lock onto a back surface of the cylindrical portion.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
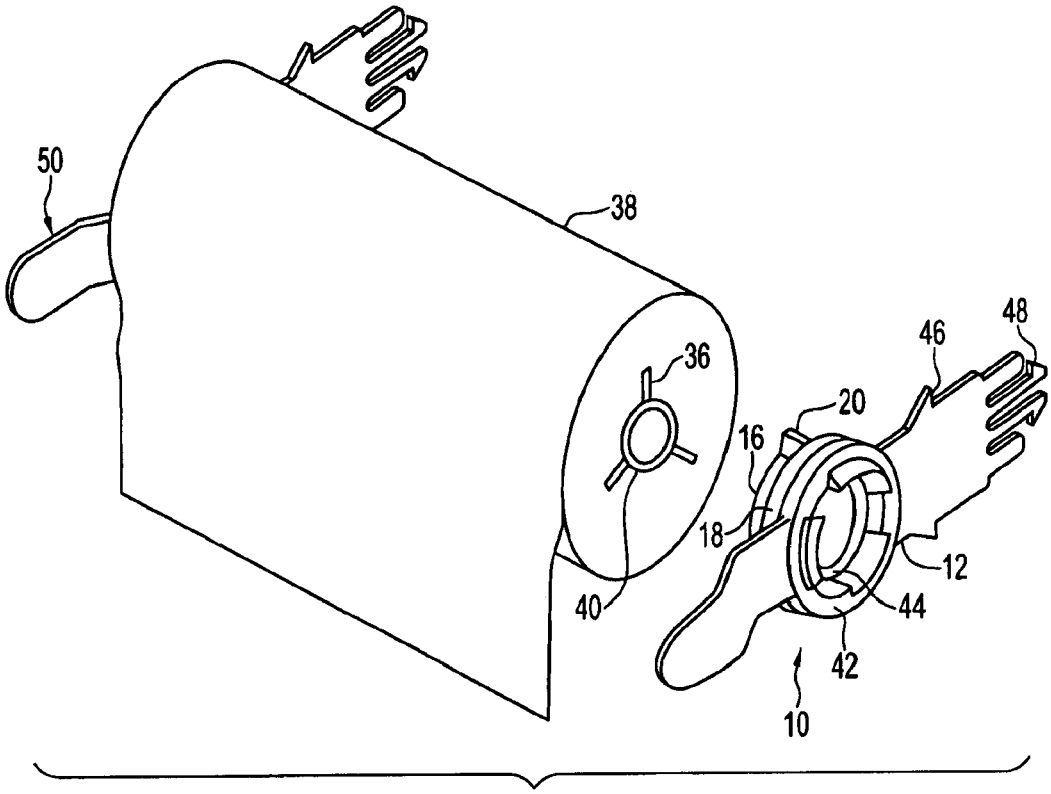
FIG. 1 is an exploded perspective view of a paper towel roll with a pair of roll support arms according to a preferred embodiment of the present invention.
Figure 2:
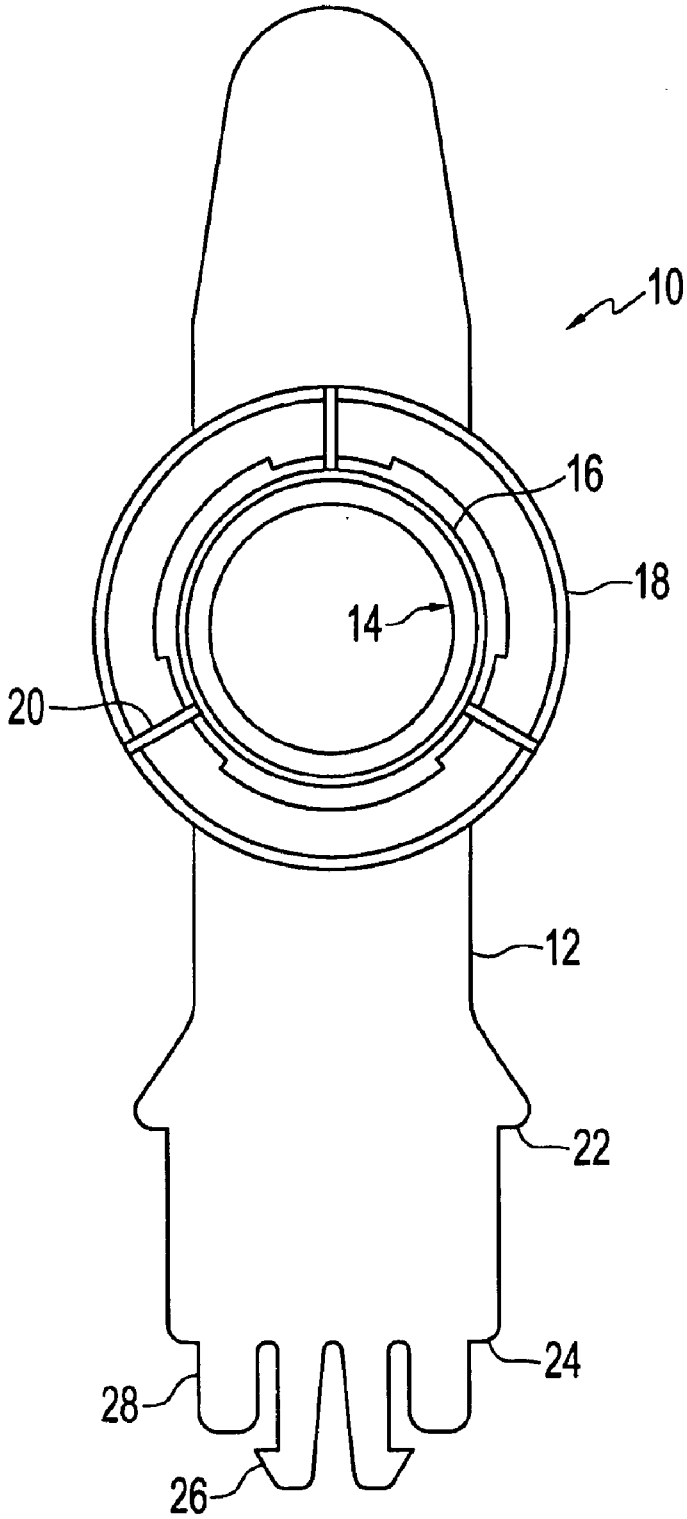
FIG. 2 is front elevation view of the roll support arm which fits only paper towel rolls having three equi-spaced slots.
Figure 3:
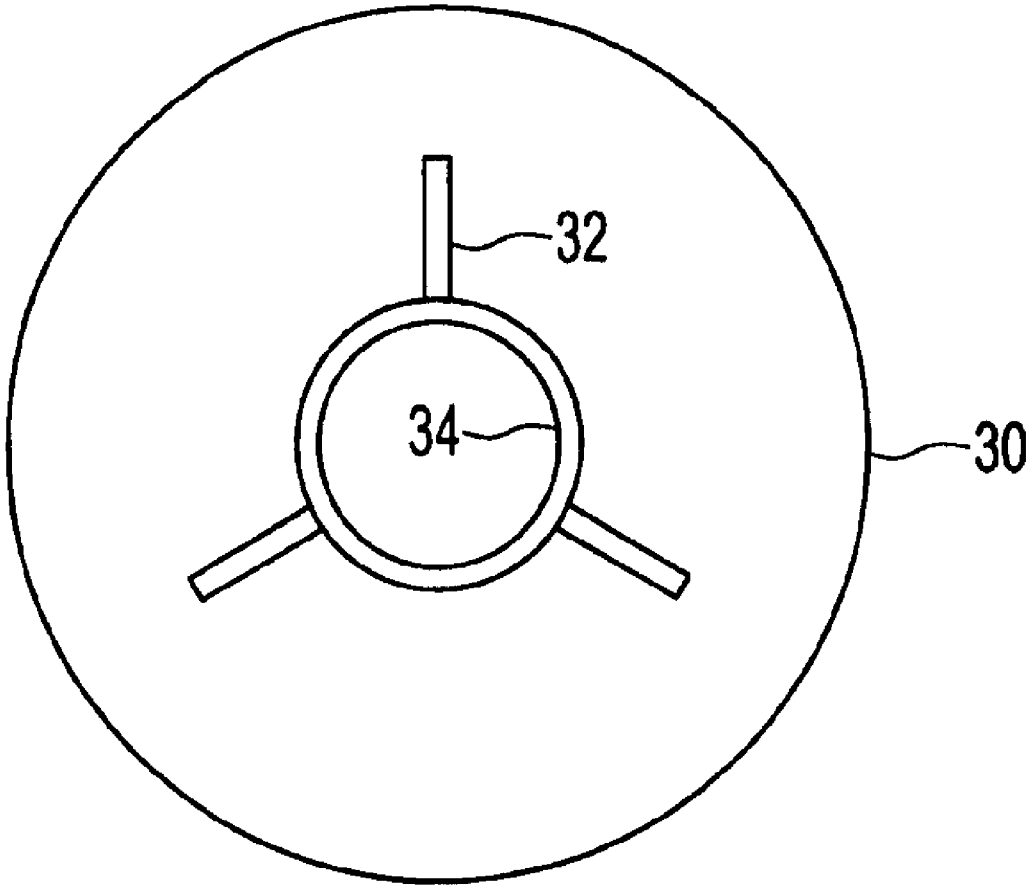
FIG. 3 is an end view of the end of a paper towel roll that has three equi-spaced slots.

Referring to FIG. 1, a large roll of paper towel material 38 has notches 36 cut into one end from an inner sleeve 40 into the paper. An arm support 10 has a rotatable cylindrical inner sleeve portion 16 and outer sleeve portion 18 interconnected with radially directed webs 20. A cylindrical portion 42 of arm support 10 forms the base around which inner sleeve portion 16 rotates. Inner sleeve portion 16 has three guides 44 each with a shoulder that loosely engages the back of cylindrical portion 42. Outer sleeve portion 18 rotates against cylindrical portion 42. Together outer sleeve portion 18 and guides 44 constrain the inner and outer sleeve portions 16 and 18 to rotational movement.

Arm region 12 has shoulder 46 and prongs with abutments 48 which cooperate and engage a back of a dispenser panel (not shown) to hold arm support 10 rigidly against the back of the dispenser panel and, hence, support the roll 38. A similar arm support 50 is used on the opposite end of roll 38 except that it has no webs 20 to engage slots in roll 38.

It will be appreciated that in order to be mounted on arm support 10 a roll must have slots 36. Without such slots roll 38 could not pass over webs 20. If a user were to attempt to remove webs 20, inner sleeve would disengage from outer sleeve 18 causing inner sleeve 16 to fall through the hole in cylindrical portion 42 and the outer sleeve to fall away. Thus, the purchaser of the dispenser (not shown) having the arm supports 10 and 50 would have to purchase paper towel rolls having slots 36 or else cut his/her own slots 36.

It will be further understood that any number of slots could be used in any desired orientation as long as the number and orientation of the webs 20 is the same. Although webs 20 are preferred, there are other elements that could be used such as pins and corresponding holes drilled into the end of the paper roll.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A support arm for supporting a paper towel roll, said roll having selected openings in one end, in a paper towel dispenser, comprising:

(a) a dispenser engaging arm portion;

(b) a cylindrical portion affixed to said arm portion;

(c) an outer sleeve abutting a first side of said cylindrical portion;

(d) an inner sleeve slidably engaging a second side of said cylindrical portion so as to rotate within said cylindrical portion with rotation of said paper towel roll; and (e) an interconnecting structure interconnecting said inner and outer sleeves and insertable into said selected openings in the end of said paper towel roll.

2. A support arm according to claim 1, wherein said selected openings include a cylindrical opening in a center of said roll and slots cut into the end of said roll from said cylindrical opening in a preselected orientation.

3. A support arm according to claim 2, wherein said inner sleeve is slidably insertable into the cylindrical opening in the end of said roll.

4. A support arm according to claim 1, wherein said interconnecting structure is a plurality of radially directed webs extending outwardly of said inner sleeve.

5. A support arm according to claim 1, wherein said inner sleeve has a plurality of tabs with outwardly directed shoulders which can be press fitted through an opening in a center of said cylindrical portion and snap out such that said shoulders lock onto a back surface of said cylindrical portion.

6. A support arm according to claim 4, wherein breaking of said webs results in said inner and outer sleeves becoming disengaged from said cylindrical portion.

* * * * *